US007197116B2

(12) United States Patent
Dunham et al.

(10) Patent No.: US 7,197,116 B2
(45) Date of Patent: Mar. 27, 2007

(54) WIDE SCANNING X-RAY SOURCE

(75) Inventors: Bruce M. Dunham, Mequon, WI (US); John Scott Price, Niskayuna, NY (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/904,560

(22) Filed: Nov. 16, 2004

(65) Prior Publication Data

US 2006/0104418 A1 May 18, 2006

(51) Int. Cl.
*H01J 35/08* (2006.01)

(52) U.S. Cl. ..... 378/124; 378/143

(58) Field of Classification Search ..... 378/9, 378/124–125, 143–144, 119, 137, 126, 134, 378/138

See application file for complete search history.

(56) References Cited

U.S. PATENT DOCUMENTS 4,199,684 A * 4/1980 Leunbach et al. ..... 378/137
4,260,885 A * 4/1981 Albert ..... 378/45
4,521,903 A * 6/1985 Braun ..... 378/141
4,719,645 A * 1/1988 Yamabe et al. ..... 378/143
4,872,189 A * 10/1989 Frankel et al. ..... 378/119
5,099,506 A * 3/1992 Van Der Kooi et al. .... 378/144
5,612,588 A 3/1997 Wakalopulos
5,629,970 A * 5/1997 Woodruff et al. ..... 378/143
6,002,202 A 12/1999 Meyer et al.
6,160,868 A 12/2000 Snyder et al.
6,192,107 B1 2/2001 Price et al.
6,236,713 B1 5/2001 True et al.
2004/0120463 A1* 6/2004 Wilson et al. ..... 378/144
2005/0063514 A1* 3/2005 Price et al. ..... 378/119

* cited by examiner

*Primary Examiner*—Edward J. Glick
*Assistant Examiner*—Hoon Song
(74) *Attorney, Agent, or Firm*—Peter J. Vogel

(57) ABSTRACT

An imaging tube (12) includes a cathode (30) that emits an electron beam (32) and an anode (38). The anode (38) includes multiple target surfaces (36). Each of the target surfaces (36) has a focal spot that receives the electron beam (32). The target surfaces (36) generate multiple x-ray beams (42) in response to the electron beam (32). Each x-ray beam (42) is associated with one of the target surfaces (36). An x-ray imaging system (10) includes the cathode (30) and the anode (38). A controller (28) is electrically coupled to the cathode (30) and adjusts emission of the electron beam (32) on the anode (38).

30 Claims, 4 Drawing Sheets

WIDE SCANNING X-RAY SOURCE

TECHNICAL FIELD

The present invention relates generally to x-ray imaging systems, and more particularly, to a system and method of performing a wide scan of an object within an x-ray imaging system.

BACKGROUND OF THE INVENTION

Traditional x-ray imaging systems include an x-ray source and a detector array. X-rays are generated by the x-ray source, passed through an object, and are detected by the detector array. Electrical signals generated by the detector array are conditioned to reconstruct an x-ray image of the object.

CT imaging systems include a gantry that rotates at various speeds in order to create a 360° image. The gantry contains an x-ray source having a single focal spot CT tube assembly that generates x-rays across a vacuum gap between a cathode and an anode. In order to generate the x-rays, a large voltage potential is created across the vacuum gap allowing electrons, in the form of an electron beam, to be emitted from the cathode to a single target surface on the anode. In releasing of the electrons, a filament contained within the cathode is heated to incandescence by passing an electric current therethrough. The electrons are accelerated by the high voltage potential and Impinge on the target surface at a single focal spot, whereby they are abruptly slowed down, directed at an impingement angle $\alpha$ of approximately 90°, to emit x-rays through a CT tube window.

Traditionally, scanning widths of an object have been limited due to the feasibly usable maximum angle of the x-ray beam and capabilities of the detector array, which in combination affect quality of a reconstructed image. Typical scanning widths of an imaging tube are approximately 10 mm. The width of the x-ray beam at the detector array is 10 mm and thus the width of the detector array is also 10 mm. With recent developments in CT detector arrays that indicate that the total detector array width or number of slice capability is increasing, limitation of scanning width has become increasingly more dependent upon maximum angle of the x-ray beam. Current CT imaging systems have 16-slice capability, and larger slice capability is foreseeable in the future.

It has been suggested to utilize the current x-ray source with updated larger width detector arrays. A fundamental limit exists when using a single focal spot tube with larger width detector arrays. The larger the width of the detector arrays the more cone-beam artifacts that are produced, causing a reduction in image quality. Another limit associated with single focal spot tubes is that the resolving power of the electron beam decreases from a center ray, extending through the center of the focal spot, towards outer edges of the focal spot. Therefore, detector elements farther away from a center of the focal spot receive a lower resolving power causing poorer image quality for the elements with lower resolving power.

It is also desirable in CT imaging to increase speed of an imaging system without degradation of image quality. CT imaging systems are limited in scanning speed of an image due to the maximum angle of the x-ray beam. With the current scanning angle, for example, only a portion of an organ can be scanned for a single revolution of the gantry, thus requiring multiple rotations and significant amounts of scanning time.

Additionally, in design of an imaging system several other concerns are to be taken into account. One is the desire to mitigate problems associated with conditioning surfaces of a target in preparation for high voltage application.

Another desire is to minimize high voltage instability within the imaging tube. One mechanism for high voltage instability is high vapor pressure, due to gas species such as background gas, surface-absorbed gas, target surface bulk absorbed gas, or track material atoms. These gas species provide ionization targets for incident electron flux producing charged ions. The charged ions and excess electrons produce a low impedance path between high anode and cathode direct current (DC) potentials, which generates "spit" activity. Spit activity can reduce image quality and potentially prevent image reconstruction.

Thus, there exists a need for an improved imaging system that is capable of performing a wide scan of a patient organ or of an object with increased scanning speed while at least maintaining current image quality.

SUMMARY OF THE INVENTION

The present invention provides a system and method of performing a wide scan of an object within an x-ray imaging system. One embodiment of the present invention provides an imaging tube that includes a cathode and an anode. The cathode emits an electron beam. The anode includes multiple target surfaces. Each of the target surfaces has a focal spot that receives the electron beam. The target surfaces generate multiple x-ray beams in response to the electron beam. Each x-ray beam is associated with one of the target surfaces.

Another embodiment of the present invention provides an x-ray imaging system that includes the cathode and the anode. A controller is electrically coupled to the cathode and adjusts emission of the electron beam on the anode.

The embodiments of the present invention provide several advantages. One such advantage is the provision of an imaging tube having an adjustable cathode and an anode having multiple target surfaces, together providing a relatively wide scan as compared to traditional imaging tubes. The electron beam of the cathode may be steered and the focal spot of that electron beam may be altered in response to electrical potentials within the electron beam "gun" or cathode. In providing a wide scan, the present invention is capable of scanning a full organ in a single rotation of a gantry, thereby, increasing scanning speed and minimizing x-ray exposure to a patient.

Another advantage provided by an embodiment of the present invention is the provision of a cathode that is a member of a replaceable subassembly, which allows the cathode to be easily maintained and replaced.

Furthermore, another advantage provided by an embodiment of the present invention is the efficient x-ray production by incorporating forward angle x-ray generation for incident angles less than 90°, which allows for greater x-ray radiation output per unit of heat or power input into a target surface. This increases efficiency of an imaging tube.

Moreover, another advantage provided by an embodiment of the present invention is the provision of an x-ray window that has a length that corresponds with a width associated with multiple adjacently emitted x-ray beams and as such minimizes x-ray absorption or thermal absorption by the x-ray window, thus minimizing the temperature of the window so that the window does not experience thermal or heat-related mechanical stresses, cracks, fractures, or other undesirable characteristics.

The present invention itself, together with attendant advantages, will be best understood by reference to the following detailed description, taken in conjunction with the accompanying figures.

BRIEF DESCRIPTION OF THE DRAWINGS

For a more complete understanding of this invention reference should now be had to the embodiments illustrated in greater detail in the accompanying figures and described below by way of examples of the invention wherein.

DETAILED DESCRIPTION OF THE PREFERRED EMBODIMENT

Figure 1:
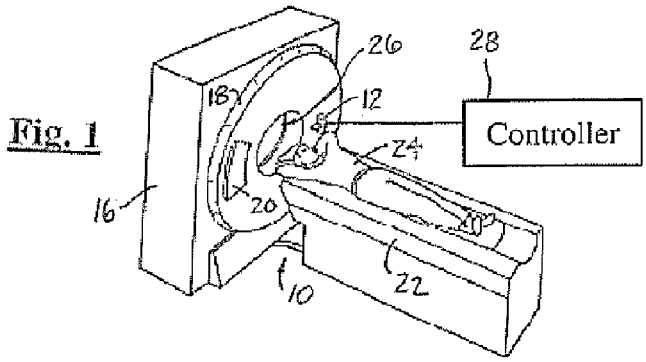
FIG. 1 is a perspective view of a CT imaging system including an x-ray source in accordance with an embodiment of the present invention.

In each of the following figures, the same reference numerals are used to refer to the same components. While the present invention is described with respect to a method and system for performing a wide scan of an object within an computed tomography (CT) imaging system, the following apparatus and method is capable of being adapted for various purposes and is not limited to the following applications: CT systems, radiotherapy systems, x-ray imaging systems, ultrasound systems, nuclear imaging systems, magnetic resonance spectroscopy systems, and other applications known in the art.

Also, the present invention although described as being used in conjunction with a CT tube may be used in conjunction with other imaging tubes including x-ray tubes and vascular tubes.

Additionally, the terms "wide scan" refer to an x-ray source scanning width that is approximately greater than 10 mm. For example, in one embodiment of the present invention an x-ray source of the present invention has a scanning width of approximately 90 mm, which is significantly larger than scanning widths of traditional x-ray sources.

In the following description, various operating parameters and components are described for one constructed embodiment. These specific parameters and components are included as examples and are not meant to be limiting.

Referring now to FIG. 1, a perspective view of a CT imaging system 10 including an x-ray source or x-ray imaging tube assembly 12 in accordance with an embodiment of the present invention is shown. The imaging system 10 includes a gantry 16 that has a rotating inner portion 18 containing the imaging tube assembly 12 and a detector array 20. The imaging tube assembly 12 projects multiple x-ray beams towards the detector array 20. The detector array 20 may be of various type and size and may have multiple slices of which all or only a portion may be used at any given time. The imaging tube assembly 12 and the detector array 20 rotate about an operably translatable table 22. The table 22 is translated along a z-axis between the imaging tube assembly 12 and the detector array 20 to perform a helical scan. The x-ray beams after passing through the medical patient 24, within a patient bore 26, are detected at the detector array 20 to generate projection data that is used to create a CT image. The x-ray beams in combination provide a wide scan of a portion of the patient 24 within a single gantry revolution. A controller 28 is also coupled to the imaging tube assembly 12 and determines operating parameters of the imaging tube assembly 12.

Figure 2:
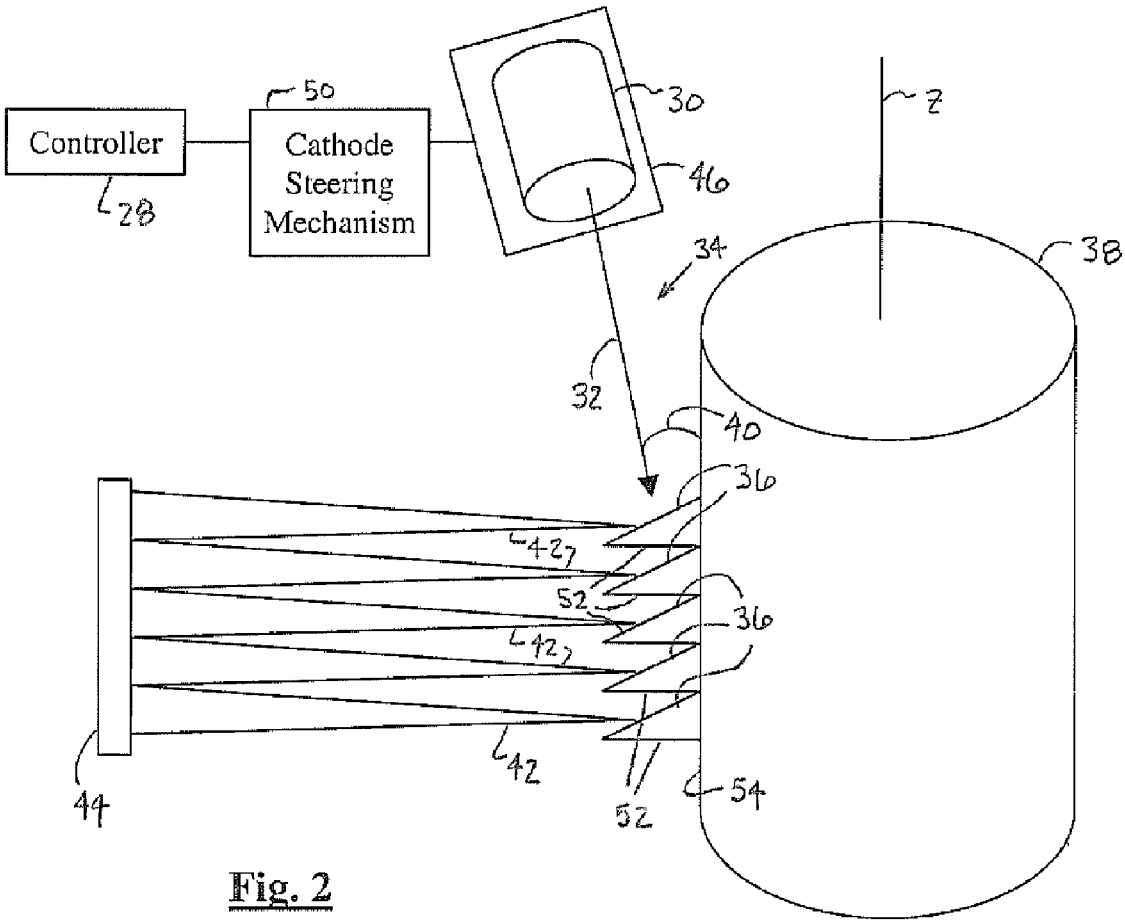
FIG. 2 is a side perspective and block diagrammatic view of internal CT tube components of the x-ray source in accordance with an embodiment of the present invention.

Referring now to FIG. 2, a side perspective and block diagrammatic view of internal CT tube components of the imaging tube assembly 12 in accordance with an embodiment of the present invention is shown. The CT tube components include a cathode or electron gun 30 that generates and emits electrons across a vacuum gap 34 in the form of an electron beam, represented by arrow 32, which is directed along one of several emission axes at and corresponding with one of several target surfaces 36 on a rotating anode 38. In a reflection or "back-scatter" mode bremsstrahlung is employed to generate x-rays. The electrons gain kinetic energy necessary for generating appropriate bremsstrahlung x-ray flux and emerge from the cathode 30 and impinge upon the target surfaces 36. The anode 38 rotates about a vertical center z-axis. The emission axes have shallow incident angles 40 (only one is shown) with the target surfaces 36 that are approximately between 20° and 90° relative to the z-axis. The shallow incident angles 40 allow for increased x-ray radiation output per unit of heat or power input into the target surfaces 36. The electron beam 32 upon impact with the target surfaces 36 generates x-ray beams 42, which are directed through a window 44 of an imaging tube (not shown).

The cathode 30 is in the form of a self-contained electron gun and is a member of a replaceable subassembly 46 that is easily maintained and replaced. Although a single electron gun 30 is shown, any number of electron guns may be utilized. The electron gun 30 may have an insulating layer (not shown), which may be formed of ceramic and be of various shape. An advantage to using a self-contained electron gun is mitigation of associated problems in conditioning surfaces in a target in preparation for high voltage application. By using an electron gun there is no static electric field gradient present at the target surfaces 36 when the electron beam 32 is incident, thereby reducing the necessity for target and cathode surface conditioning, Also, since there is no DC electric field gradient present, incidence of "spit" activity is reduced.

The cathode 30 is not limited to use of a thermionic tungsten wire coil that is traditionally used in imaging tubes, many other electron sources may be used. One electron source that may be used includes field emitter arrays formed from Spindt cones, barrel or hollow cylinders, carbon nanotubes, or physical vapor deposition or chemical vapor deposition layers that give rise to field emitting carbon structures or photoemitters. In a sample embodiment, an electron source having a focusing electrode with a variable potential applied therein is used. With a variable potential applied to the focusing electrode usefulness of the imaging tube is increased to include cardiac and angio functions, where focal spot variability is necessary. In addition, the focusing electrode may be utilized in standard fluoroscopic and radiographic modalities.

Current of the cathode 30 may be varied similar to a traditional cathode having a tungsten coil wire filament. Emission current or 'beam current' is controlled by the direct heating of the coiled tungsten wire (not shown) within the cathode 30. Emission current or beam current is controlled in different fashions using different emission techniques. For example, the local electric field is changed to produce more or less current from field emission devices. For Spindt-type cone-shaped field emitters, this implies controlling the gate voltage near the tip of the emitter cone. The metal in a dispenser cathode is raised to higher or lower temperatures by means of a direct or indirect heater. The low work function of the metal in the dispenser cathode promotes electron emission at lower temperatures than from a bare tungsten emitter.

The cathode 30 is capable of accelerating the electron beam 32 at various kinetic energies, depending upon the patient or object being scanned, as opposed to using a cathode with a fixed high-voltage for all objects. Independent of the final electron energy the use of an electron gun that is substantially isolated from the remainder of the chamber or tube volume lowers the voltage drop from the gun 30 to the target surfaces 32, in turn suppressing discharge or arc-forming mechanisms. This in turn reduces the number of vacuum arc events or 'spits'. By minimizing arc-forming mechanisms a diagnostician is better able to observe organ motion during a "cine" mode exam, for example, during a cardiac scan due to fewer interruptions in image brightness. Reduction or elimination of the high electric fields at the target surfaces 36 and near the high-temperature regions of the cathode 30 reduces the amount of accelerating electric field non-uniformities and increases ease of tailoring electric fields near the target surfaces 36 for increased accuracy in focal spot size, location, and shape generation.

Ability of the cathode 30 to alter direction of the electron beam 32 at various angles allows for generation of the electron beam 32 at the shallow incident angles 40. Direction alteration of the electron beam 32 may be performed within the cathode 30, by rastering the electron beam 32 across the target surfaces 36, or through movement of the cathode 30 via a cathode steering mechanism 50. Direction of the electron beam 32 may also be altered within an imaging tube, allowing for an electron beam angle other then approximately 90° without altering shape of the resulting electron beam.

The cathode 30 is positioned a predetermined distance from the target surfaces 36 to minimize a maximum steering angle and a maximum rastering angle of the cathode 30 and electron beam 32, respectively. In positioning the cathode 30 at the predetermined distance the cathode 30 is positioned such that the electron beam 32 may be directed at each target surface 36 without interference from other target surfaces.

Focusing level and shape of the electron beam 32 is adjustable within the cathode 30, which further allows the electron beam 32 to be rastered over the target surfaces 36. Adjustment of electron acceleration, electron beam focusing, and cathode steering is minimized between the cathode 30 and the anode 38 by generating uniform focal spots for each target surface 36 such that each target surface 36 has a similar focal spot.

The anode 38 rotates to increase average power capacity of the target surfaces 36, as well as to increase the amount of temperature abatement. The anode 38 may be internally cooled via a support shaft (not shown) coupled to a liquid metal by rotating seals (not shown). Thermal energy generated at the target surfaces 36 is transferred through the shaft to the liquid metal and finally to a cooling oil through a transfer component (not shown) where the energy is removed from the corresponding imaging tube. For further explanation of the described cooling apparatus see U.S. Pat. No. 6,160,868, entitled "X-ray Tube Apparatus Employing Liquid Metal for Heat Removal". Of course, other cooling methods known in the art may be used, such as x-ray tube apparatuses that use water, mixtures of water and ethylene glycol, or mixtures of water and other cooling fluids and/or materials to increase heat capacity and cooling power. When rotating seals are used the anode is coupled to ground or is at ground potential.

Figure 7:
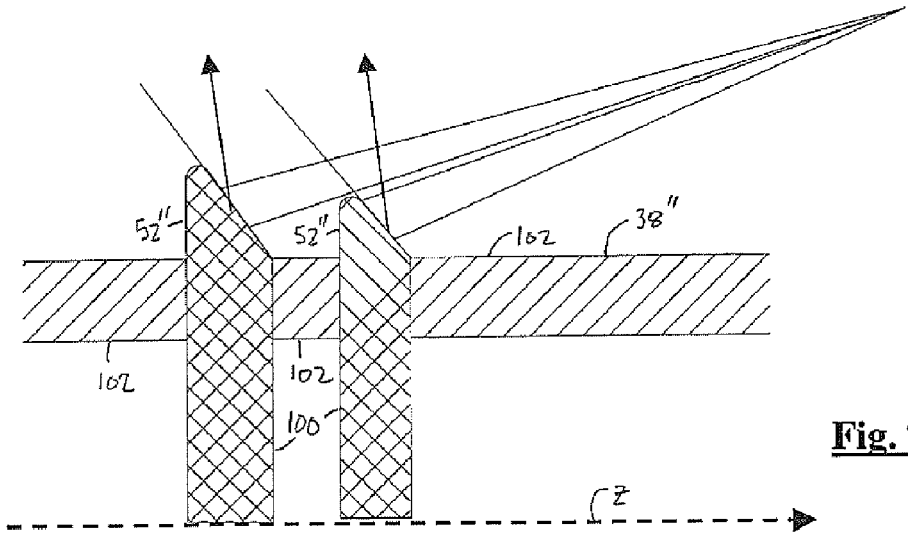
FIG. 7 a half cross-sectional view of a rotating anode, incorporating track rings, in accordance with still another embodiment of the present invention.

Although the anode 38 is shown in the form of a cylinder or drum having multiple target surfaces, the anode 38 may be in some other form, also having multiple target surfaces. The anode 38 may be in the form of a single support element or may be in the form of multiple rings, as shown in FIG. 7.

The target surfaces 36 are on multiple tracks 52 that may be wedge shaped, as shown. The tracks 52 may correspond to multiple rings forming the anode 38, as shown in FIG. 7, be in the form of material layers formed around an exterior surface 54 of the anode 38, or be in some other form known in the art. The tracks 52 may be brazed or welded on to the exterior surface 54, brazed or welded as stacked rings, fastened to the anode 38, integrally formed as part of the anode 38, or coupled to the anode 38 using some other method known in the art. The anode 38 may be casted as a single component and then machined to form the tracks 52. The tracks 52 may be formed of carbon graphite and have a top layer formed of tungsten, which is a high-Z material to have a high melting point, The tracks 52 may also be formed of other materials having a similar high melting point.

The window 44 is transmissive for electrons at a beam potential between approximately 80 kV and 120 kV, without electron beam loss or heating of the window 44. The window 44 may be formed of beryllium or similar material known in the art. When beryllium is not used or the window 44 is not as transmissive for the above potentials window-cooling methods known in the art may be utilized, In operation, as the anode 38 rotates about the patient 24, a protocol within the controller 28 determines appropriate steering angle, how the electron beam 32 is rastered across the target surfaces 36, focal spot positioning, focusing level of the gun 30, shape of the electron beam 32, and other parameters affecting x-ray generation.

The controller 28 may be microprocessor based such as a computer having a central processing unit, memory (RAM and/or ROM), and associated input and output buses. The controller 28 may be an application-specific integrated circuit or be formed of other logic devices known in the art. The controller 28 may be a portion of a central main control unit, an interactive dynamics module, or may be a stand-alone controller as shown.

Figure 3:
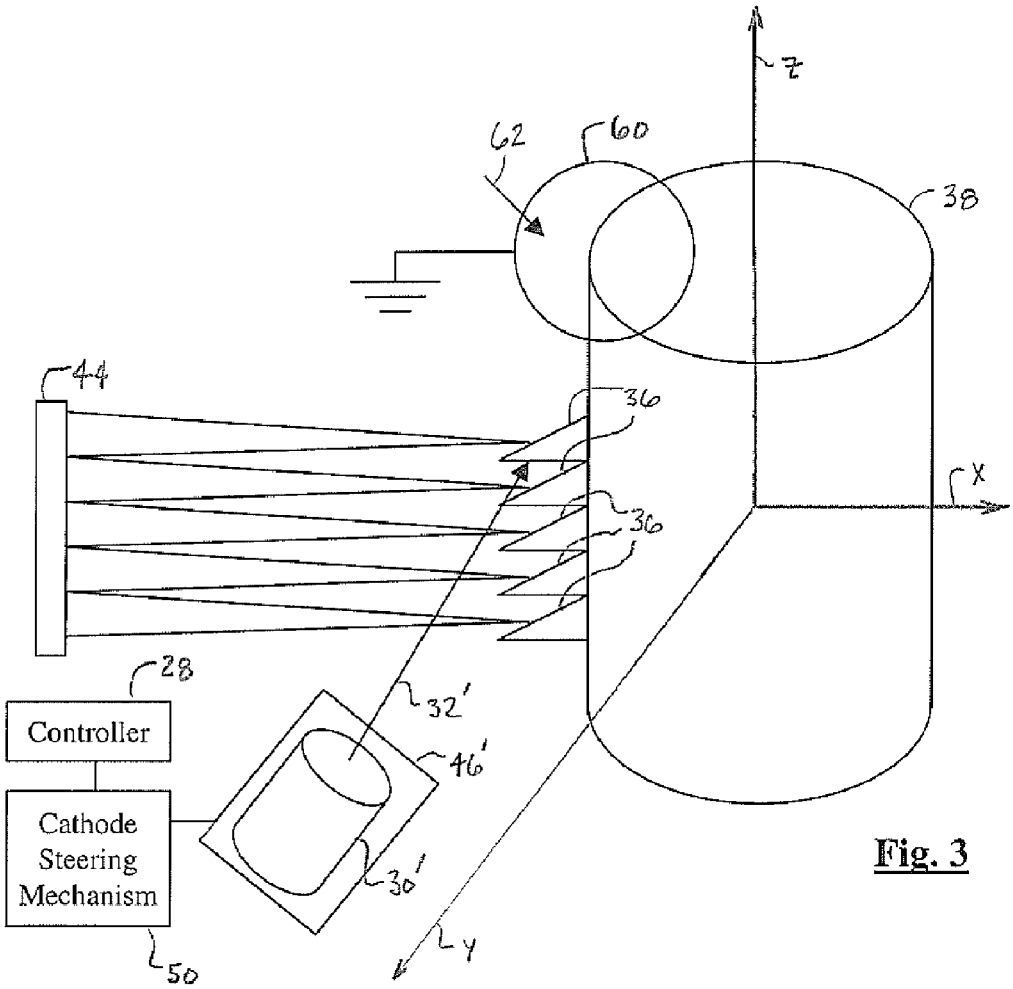
FIG. 3 is a side perspective and block diagrammatic view of internal CT tube components of the x-ray source in accordance with another embodiment of the present invention.

Referring now to FIG. 3, a side perspective and block diagrammatic view of internal CT tube components of the imaging tube assembly 12 is shown in accordance with another embodiment of the present invention. The cathode 30', having subassembly 46', instead of being in plane with the anode 38 may be out of plane with the anode 38, as represented by the y-axis. The off-axis oriented cathode 30' allows for the use of an electron forward scatter collector 60. The collector 60 may be included within the imaging tube and passively collect electrons of a scattered beam, represented by arrow 62, generated upon Incidence of the electron beam 32' on the target surfaces 36. The collector 60 is shunted to ground potential and minimizes heat generated at the target surfaces 36 and increases over-all efficiency of the imaging tube.

Figure 4:
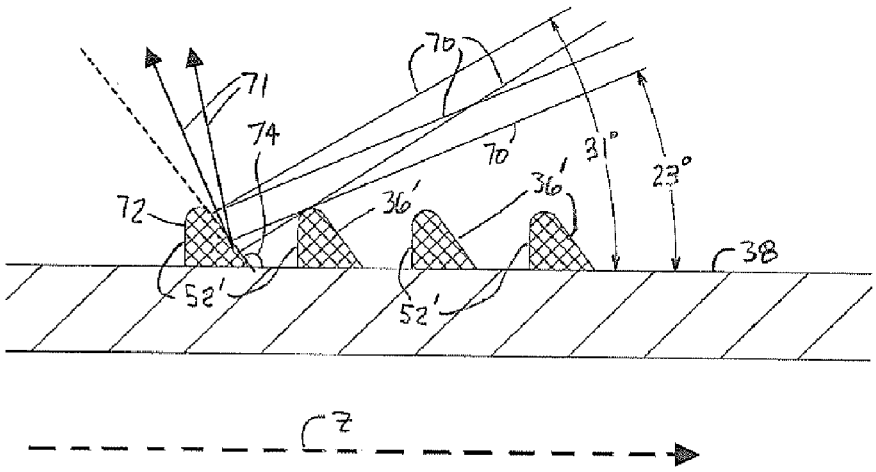
FIG. 4 a half cross-sectional view of a rotating anode in accordance with an embodiment of the present invention.

Referring now to FIG. 4, a half cross-sectional view of the rotating anode 38 is shown in accordance with an embodiment of the present invention. Incident electron rays 70 are shown as impinging upon multiple target surfaces 36' of tracks 52' to form x-rays 71. A sample useful x-ray emission angle range of approximately between 23°–31° is shown for a first track 72. The angles of emission for each track 52' may be adjusted or modified to provide desired emission angles. Notice that a single-track emission angle 74 may correspond to multiple incident angles or a range of incident angles. In one embodiment, electron beam length is approximately 5 mm and electron beam width is approximately 1–2 mm. The provided electron beam dimensions are example dimensions that provide an electron beam spot that produces sufficiently high resolution for use within a CT system, of course, other dimensions may be utilized. The emission of the electron rays 70 may be steered by the controller 28 onto different rings for x-ray emission illuminating different portions of the subject or patient along the z-axis. Although four tracks are shown, any number of tracks may be utilized. Also, the spacing between tracks, and the height, width, and shape of the tracks may vary per application.

Figure 5:
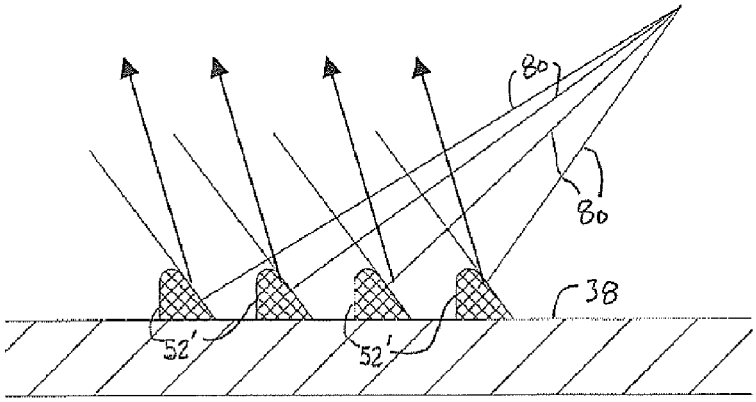
FIG. 5 a half cross-sectional view of a rotating anode in accordance with another embodiment of the present invention.

Referring now to FIG. 5, a half cross-sectional view of the rotating anode 38 is shown, illustrating electron beam emission directed at the tracks 52', in accordance with another embodiment of the present invention. An electron beam, such as beams 32 and 32', having rays 80 may be steered and directed at a single track or multiple electron beams (although not shown) may be directed at multiple tracks simultaneously. When directing an electron beam at multiple tracks simultaneously, multiple cathodes or electron sources are utilized. The tracks 52' may be utilized sequentially or in varying order and be utilized based on a predetermined or defined sequence. When sequencing through the tracks 52', certain tracks may be skipped. X-rays may be generated In a continuous, DC mode, or in a pulsed format. Any sequence of tracks 52' may be utilized. The geometrical arrangement of an electron gun, tracks, and an anode, such as guns 30 and 30', tracks 52 and 52', and anode 38, respectively, may be adjusted to enhance efficiency. For example, the angle of incidence may be adjusted to improve upon the amount of usefully generated x-rays.

Figure 6:
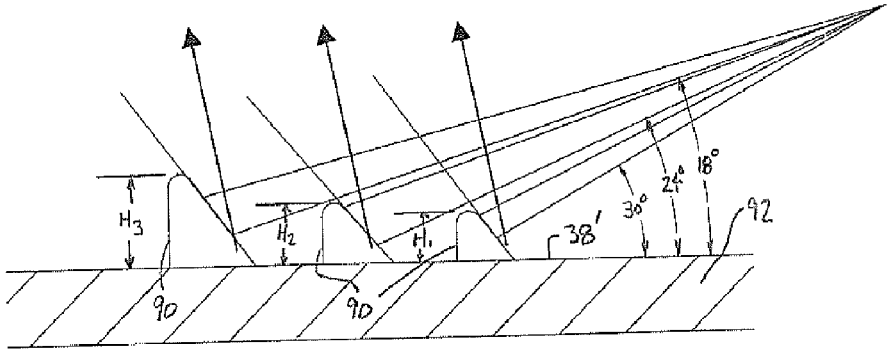
FIG. 6 a half cross-sectional view of a rotating anode, incorporating tracks having varying height, in accordance with another embodiment of the present invention.

Referring now to FIG. 6, a half cross-sectional view of a rotating anode 38', incorporating tracks 90 having varying height, is shown in accordance with another embodiment of the present invention. The varying heights or more specifically, as shown the incrementally increasing heights $H_1$, $H_2$, and $H_3$ of the tracks 90 provides advantages for placement of an electron gun and an associated electron gun incident angle or angle of attack. Sample incident angles of 30°, 24°, and 18° are shown for a single electron beam and are associated with track heights $H_1$, $H_2$, and $H_3$, respectively. Tracks 90 with stepped dimensions, as shown, allow for a slimmer profile of the associated electron gun and target. The electron gun may be positioned closer to the anode 38'. Heat transfer from each electron beam spot on each track 90 into the cylinder or body 92 of anode 38' is different.

Referring now to FIG. 7, a half cross-sectional view of a rotating anode 38", incorporating track rings 100, is shown in accordance with another embodiment of the present invention. Various construction methods may be utilized to form the above-described anodes 38, 38' and 38" and associated tracks 52, 52', and 52" of FIGS. 2–7. Separate target discs or rings including the track rings 100 and cylinder rings 102 can be sandwiched together and bonded with standard target brazing techniques to form the stated anodes. The track rings 100 and the cylinder rings 102 may be referred to as body structural rings since they form and are structural components of the anodes, such as the anode 38", as shown. The track rings 100 and cylinder rings 102 may be formed of carbon, steel, or other material known in the art The materials may be determined based on thermal coefficients of expansion and behavior under electron bombardment, thermal energy experienced at the focal spots on the target surfaces and during high speeds of rotation.

Figure 8:
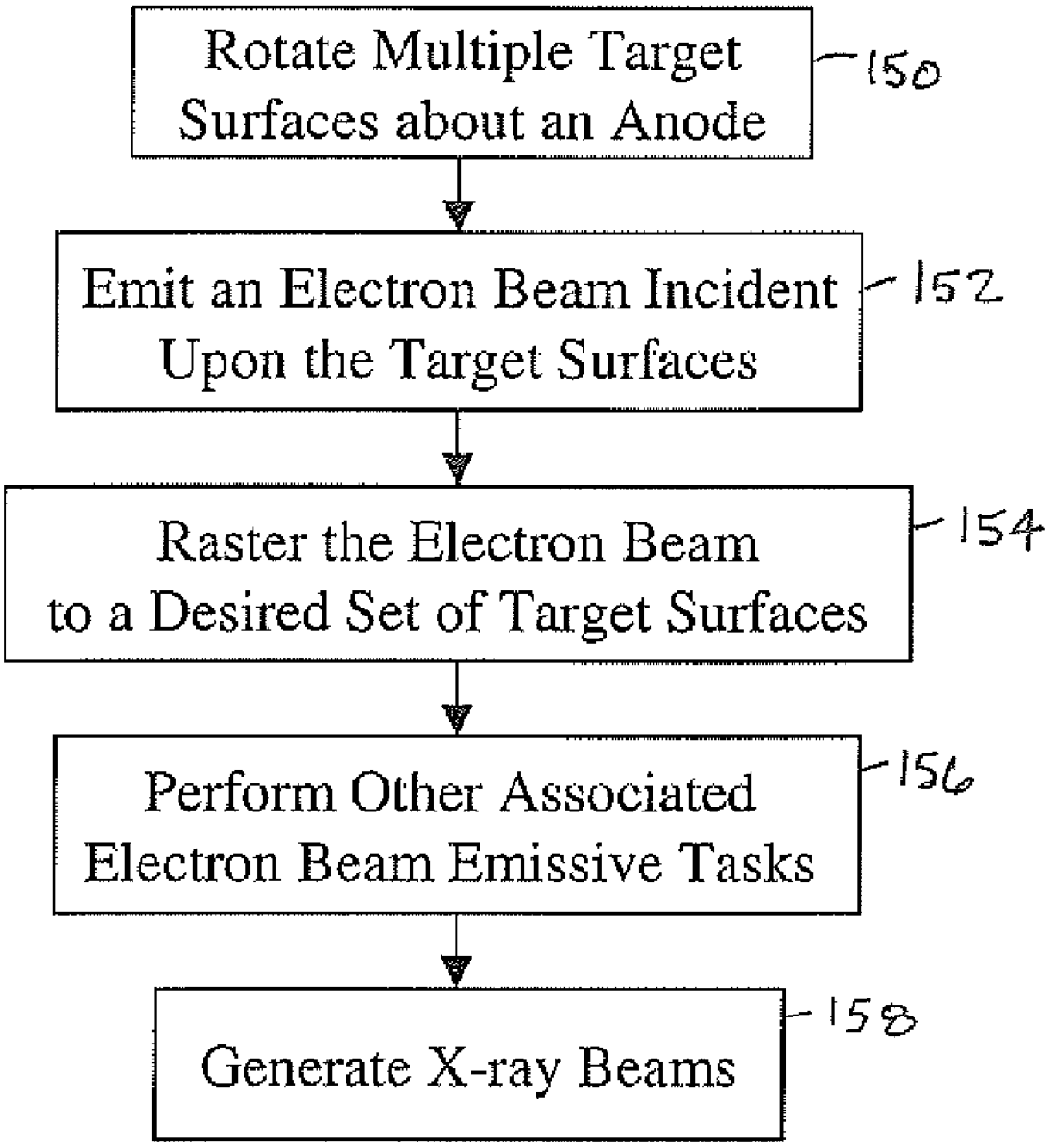
FIG. 8 is a logic flow diagram illustrating a method of scanning an object within an x-ray imaging system in accordance with an embodiment of the present invention.

Referring now to FIG. 8, a logic flow diagram illustrating a method of scanning an object within an x-ray imaging system in accordance with an embodiment of the present invention is shown.

In step 150, the target surfaces of an anode, such as the anodes 38, 38', and 38" are rotated about a center axis, such as the z-axis, to provide cooling of the target surfaces.

In step 152, the controller 28 sequentially steers the cathode or rasters the electron beam, such as beams 32 and 32', at each target surface that is being utilized for a particular scan. The cathode may be similar to the electron guns 30 and 30'. Sequentially adjusting direction of the electron beam on the target surfaces can occur in approximately a few milliseconds, which allows a full organ to be scanned in a fraction of the time required of prior CT scanning systems.

In step 154, an electron beam is emitted from the cathode and is incident upon the target surfaces. The target surfaces that are used for a particular scan have an associated scan width that corresponds with an active detector width of the detector array. The controller 28 determines which target surfaces to utilize in response to a determination of the active detector width. The electron beam is formed to uniformly generate the focal spots on each of the target surfaces.

In step 156, multiple tasks may also be performed including: adjusting emission of the electron beam; focusing the cathode; adjusting voltage potential of various imaging tube components; adjusting current of the cathode; steering the electron beam, or other various tasks. For example, the voltage potential of the cathode may be gated. The electron beam is gated by gridding or pulsing high-voltage potential of the cathode to correspond in time with the rotation of used x-ray exposed portions of an anode.

In step 158, the x-ray beams are generated in response to the impact of the electron beam on the target surfaces. The x-ray beams are emitted from the target surfaces to exit an imaging tube window, such as window 44.

The above-described steps are meant to be an illustrative example; the steps may be performed synchronously or in a different order depending upon the application.

The present invention therefore provides an imaging system including an imaging tube with increased coverage that has increased scanning speed. The present invention is capable of scanning a whole organ in relatively a small number of scans rendering procedures such as organ perfusion feasible on short time scales allowing capture of organ function to occur quickly. By using a cylindrically symmetric target a single electron source may be used, simplifying an imaging tube over use of multiple electron sources. The use of a single electron source also minimizes power dissipation necessary in scanning of an object.

The present invention provides high voltage stability and events such as arcs, discharges, and spits are reduced. The present invention prevents high vapor pressures that often develop within an imaging tube insert from creating a path to ground or a high voltage opposite polarity, which in turn prevents the perturbing of high voltage stability. This is especially beneficial in applications, such as cardiac scanning, where the time of the patient subjected to contrast media is limited by body tolerance to the injected or ingested contrast medium and the scan time. High voltage stability allows for increased imaging tube life. High voltage stability also strengthens sub-component design and provides increased robustness and longer tube operating life from a reduction in arcing or discharges that tend to shorten lifetime of high-voltage generator equipment and damage surfaces internal to a tube vacuum enclosure.

By simplifying the imaging tube manufacturing time and costs of the imaging tube are also decreased. Exhaust times and temperatures are reduced for high vacuum preparation. Lengthy high-voltage seasoning is also minimized.

The x-ray source of the present invention simplifies the implementation of glancing angle x-ray production (HEXLAB effect), since the electric fields are confined to the interior of the x-ray source. One can choose a beam angle different than perpendicular and not alter the shape of the resulting electron beam.

Since the electron emission source of the present invention is protected from the harsh high electric field environment of the tube, emitters other than coiled tungsten wire filaments may be utilized. Since the emitter is partially isolated from the parts of the tube that are traditionally at high temperature and subject to high E-field stress other emitter types, such as field emitter, field emitter arrays, carbon nanotube emitters and arrays, and dispenser cathodes, can be used.

While the invention has been described in connection with one or more embodiments, it is to be understood that the specific mechanisms and techniques which have been described are merely Illustrative of the principles of the invention, numerous modifications may be made to the methods and apparatus described without departing from the spirit and scope of the invention as defined by the appended claims.

What is claimed is:

1. An imaging tube comprising:

a cathode emitting at least one electron beam; and an anode comprising a plurality of target surfaces having a plurality of focal spots, said plurality of target surfaces on a plurality of individually mounted tracks that are mechanically coupled to an exterior side of said anode; wherein said plurality of focal spots receiving said at least one electron beam and reflectively generating a plurality of x-ray beams off of said target surfaces and directed away from said anode, each of said x-ray beams associated with one of said plurality of target surfaces.

2. An imaging tube as in claim 1 wherein said plurality of tracks have different heights.

3. An imaging tube as in claim 1 wherein said plurality of tracks are stacked rings.

4. An imaging tube as in claim 1 wherein said plurality of tracks are integrally formed as part of said anode.

5. An imaging tube as in claim 1 wherein said plurality of focal spots reflectively generate said plurality of x-ray beams off of said plurality of tracks.

6. An imaging tube comprising:

a cathode emitting at least one electron beam; and an anode comprising a plurality of target surfaces having a plurality of focal spots, said plurality of target surfaces on a plurality of individually mounted tracks that are mechanically coupled to an exterior side of said anode;

said plurality of focal spots receiving said at least one electron beam and reflectively generating a plurality of x-ray beams, each of said x-ray beams associated with one of said plurality of target surfaces;

wherein said anode comprises;

a plurality of body rings; and a plurality of target rings stacked with said body rings.

7. An x-ray imaging system comprising:

a cathode emitting at least one electron beam;

an anode comprising a plurality of target surfaces having a plurality of focal spots, said plurality of target surfaces on a plurality of tracks that are mechanically coupled to said anode and have different heights;

said plurality of focal spots receiving said at least one electron beam and generating and directing a plurality of x-ray beams away from said anode, each of said x-ray beams associated with at least one of said plurality of target surfaces; and a controller electrically coupled to said cathode and adjusting emission of said at least one electron beam on said anode.

8. A system as in claim 7 wherein said anode is in the form of a cylinder.

9. A system as in claim 7 wherein said cathode is a sealed electron source.

10. A system as in claim 7 wherein said cathode is an electron gun.

11. A system as in claim 7 wherein said controller adjusts at least one of focusing, voltage potential, steering angle, rastering angle, electron energy acceleration level, and current of said cathode.

12. A system as in claim 7 further comprising a cathode steering mechanism mechanically coupled to said cathode and electrically coupled to said controller and said controller steering said at least one electron beam over a range of angles.

13. A system as in claim 7 wherein said controller rasters said cathode over said plurality of target surfaces.

14. A system as in claim 7 wherein said plurality of tracks are stacked rings.

15. A system as in claim 7 wherein said plurality of tracks are integrally formed as part of said anode.

16. A system as in claim 7 wherein said plurality of target surfaces are a predetermined distance from said cathode.

17. A system as in claim 7 wherein said anode comprises a plurality of rings each ring corresponding to a target surface of said plurality of target surfaces.

18. A system as in claim 17 wherein said plurality of rings are formed by layers of material applied to said anode.

19. A system as in claim 7 further comprising a collector passively collecting electrons of a scattered beam generated upon incidence of said at least one electron beam on said plurality of target surfaces.

20. A system as in claim 7 wherein said cathode is a member of a replaceable subassembly.

21. A system as in claim 7 wherein said cathode comprises a variable potential applied focusing electrode.

22. A system as in claim 7 wherein said plurality of x-ray beams have a combined x-ray beam width of greater than 10 mm.

23. A system as in claim 7 wherein incident angles of said at least one electron beam upon said plurality of target surfaces are approximately between 20° and 90° relative to a center axis of said anode.

24. A system as in claim 7 further comprising an x-ray window having a length associated with a width of said plurality of x-ray beams.

25. A method of scanning an object within an x-ray imaging system comprising:

rotating an anode having a plurality of non-adjacent and separate target surfaces;

emitting a single electron beam incident upon said plurality of non-adjacent and separate target surfaces; and generating a plurality of x-ray beams in response to simultaneous impact of said electron beam on said plurality of non-adjacent and separate target surfaces.

26. A method as in claim 25 wherein said electron beam is emitted with an emission angle of less than or equal to approximately 30° relative to said anode and simultaneously impinges upon said plurality of non-adjacent and separate target surfaces.

27. A method as in claim 25 further comprising performing a task selected from at least one of adjusting emission of said at least one electron beam, gating voltage potential of a cathode, adjusting focusing of a cathode, adjusting voltage potential of an x-ray tube component, adjusting current of said cathode, uniformly generating a focal spot on each of said non-adjacent and separate target surfaces, and steering said at least one electron beam.

28. A method of scanning an object within an x-ray imaging system comprising:

rotating an anode having a plurality of discontinuous nonadjacent target surfaces;

emitting a single electron beam incident upon said plurality of discontinuous nonadjacent target surfaces;

generating a plurality of x-ray beams in response to simultaneous impact of said electron beam on said plurality of discontinuous nonadjacent target surfaces; and emitting a plurality of simultaneously impinging electron beams, which are emitted and simultaneously impinge upon said plurality of discontinuous nonadjacent target surfaces.

29. An imaging tube comprising:

a single electron beam source emitting at least one electron beam; and an anode comprising a plurality of stand-alone non-opposing target surfaces having a plurality of focal spots;

said plurality of focal spots receiving said at least one electron beam simultaneously and generating a plurality of x-ray beams, each of said x-ray beams associated with one of said plurality of stand-alone non-opposing target surfaces.

30. An imaging tube comprising:

a cathode emitting at least one electron beam; and an anode comprising a plurality of discontinuous nonadjacent target surfaces having a plurality of focal spots, said anode comprising and formed of a plurality of body structural rings coupled to each other, each of at least two of said body structural rings having at least one of said plurality of discontinuous nonadjacent target surfaces;

said plurality of focal spots receiving said at least one electron beam and generating a plurality of x-ray beams, each of said x-ray beams associated with one of said plurality of discontinuous nonadjacent target surfaces.

* * * * *